US007637786B2

(12) United States Patent
Hoshino et al.

(10) Patent No.: US 7,637,786 B2
(45) Date of Patent: Dec. 29, 2009

(54) ELECTRICAL CONNECTOR

(75) Inventors: Hirokazu Hoshino, Tokorozawa (JP); Naoyuki Kimura, Fuchu (JP); Yusuke Shimura, Kawasaki (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 12/130,313

(22) Filed: May 30, 2008

(65) Prior Publication Data

US 2008/0299796 A1 Dec. 4, 2008

(30) Foreign Application Priority Data

May 31, 2007 (JP) ..... 2007-145036

(51) Int. Cl.
*H01R 24/00* (2006.01)

(52) U.S. Cl. ..... 439/660; 439/74

(58) Field of Classification Search ..... 439/74, 439/60, 682, 660

See application file for complete search history.

(56) References Cited

U.S. PATENT DOCUMENTS 7,134,907 B2 * 11/2006 Watanabe et al. ..... 439/495
7,207,842 B1 * 4/2007 Kenjo ..... 439/607.01

FOREIGN PATENT DOCUMENTS

JP 2005-203139 A 7/2005
KR 10-2004-0072799 8/2004

OTHER PUBLICATIONS

Notice of Grounds for Rejection issued in Korean Application No. 10-2008-0024249 mailed Jun. 15, 2009 and English translation thereof, 8 pages.
English abstract of KR20040072799A issued Aug. 19, 2004, 1 page.

* cited by examiner

*Primary Examiner*—Khiem Nguyen
(74) *Attorney, Agent, or Firm*—Osha • Liang LLP

(57) ABSTRACT

An electrical connector includes a socket and a plug. In the socket, plural first connectors are provided in parallel, and substantially U-shaped press-fitting portions are assembled so as to cross over opening edge portions of a socket body. In the plug, plural second connectors are provided in parallel, and substantially U-shaped press-fitting portions are assembled so as to cross over opening edge portions of a plug body. The plug body has a planar shape which can be fitted in the opening edge portions of the socket body. Particularly, a free end portion of the press-fitting portion of the second connector located in the opening edge portion of the plug body is engaged with a position regulating recess formed in a bottom surface of the plug body.

10 Claims, 12 Drawing Sheets

ELECTRICAL CONNECTOR

BACKGROUND OF THE INVENTION

1. Field of the Invention

The present invention relates to an electrical connector, particularly to an electrical connector electrically connecting printed circuit boards to each other.

2. Description of the Related Art

Conventionally, in the electrical connector, a header 12 rigidly connected to a lower surface of a printed circuit board A is fitted in a socket 11 rigidly connected to an upper surface of another printed circuit board A, and a contact terminal 14 provided in the socket 11 is elastically brought into contact with a contact terminal 16 provided in the header 12, thereby connecting the printed circuit boards to each other (refer to, for example, Japanese Patent Application Laid-Open No. 2005-203139).

However, in the conventional electrical connector, plural contact terminals 16 are provided in parallel in the header 12 by insert molding. Therefore, higher dimensional accuracy is required for a metal mold with downsizing apparatus, and it takes a long time to make the metal mold, which results in a problem in that production cost is increased.

In view of the foregoing, an object of the present invention is to provide an electrical connector in which the metal mold is easily made to reduce the production cost.

SUMMARY OF THE INVENTION

In order to solve the above problems, according to an aspect of the present invention, an electrical connector includes a socket in which plural first connectors are provided in parallel, substantially U-shaped press-fitting portions being assembled so as to cross over opening edge portions of a socket body; and a plug in which plural second connectors are provided in parallel, substantially U-shaped press-fitting portions being assembled at positions corresponding to the first connectors so as to cross over opening edge portions of a plug body, the plug body having a planar shape which can be fitted in the opening edge portions of the socket body, wherein a free end portion of the press-fitting portion of the second connector located in the opening edge portion of the plug body is formed in a bottom surface of the plug body.

Accordingly, in the aspect of the present invention, because the second connector is attached after the plug is molded, the insert molding is not required. Therefore, the metal mold can easily be made to reduce the production cost.

Additionally, the free end portion does not spring because the free end portion of the second connector is engaged with a position regulating recess provided in the bottom surface of the plug. Therefore, a fluctuation is not generated in a width of the press-fitting portion of the second connector, so that a contact pressure can become even to obtain the electrical connector having high contact reliability.

In the electrical connector according to an embodiment of the present invention, preferably lateral slippage is prevented by press-fitting the substantially U-shaped press-fitting portions of the second connector in the plural substantially U-shaped press-fitting grooves provided in parallel along an outer peripheral surface of the opening edge portion of the plug body.

Accordingly, looseness is eliminated in the lateral direction of the second connector to obtain the electrical connector having the high assembly accuracy and higher contact reliability.

In the electrical connector according to another embodiment of the present invention, preferably lateral slippage preventing projections press-contacting inside surfaces of the press-fitting groove of the plug body are provided in end faces on both sides of the press-fitting portion of the second connector, and a click feeling projection is provided in a side face of the press-fitting portion located between the lateral slippage preventing projections.

In the electrical connector of the present invention, preferably lateral slippage preventing projections press-contacting inside surfaces of the press-fitting groove of the plug body are provided in end faces on both sides located outside the opening edge portion of the plug body in the press-fitting portion of the second connector, and a click feeling projection is provided in an outward surface of the press-fitting portion located between the lateral slippage preventing projections.

Accordingly, because the click feeling projection is provided in the side face adjacent to the lateral slippage preventing projections, the position slippage is hardly generated in the click feeling projection. Therefore, the electrical connector in which the fluctuation in click feeling is eliminated in the assembly work can be obtained.

In the electrical connector according to a further embodiment of the present invention, preferably an outer peripheral surface of the opening edge portion of the plug body is substantially flush with an outer peripheral surface of the press-fitting portion of the second connector.

Accordingly, the outer peripheral surface of the side wall of the plug body is substantially flush with the outer peripheral surface of the press-fitting portion of the second connector, so that the assembly work can smoothly be performed in assembling the plug in the socket.

In the electrical connector according to a still further embodiment of the present invention, preferably Ni plating is made in a boundary region between the connecting portion and press-fitting portion of the connector.

Accordingly, the electrical connector in which the Ni plating prevents a solder from rising can be obtained.

DETAILED DESCRIPTION OF THE PREFERRED EMBODIMENTS

An electrical connector according to an embodiment of the present invention will be described with reference to the accompanying drawings, FIGS. 1 to 12. As shown in FIGS. 1 to 10, the electrical connector of the embodiment includes a socket 20 connected to an upper surface of a printed wiring board 10 and a plug 40 connected to a lower surface of a printed wiring board 11.

Figure 3A:
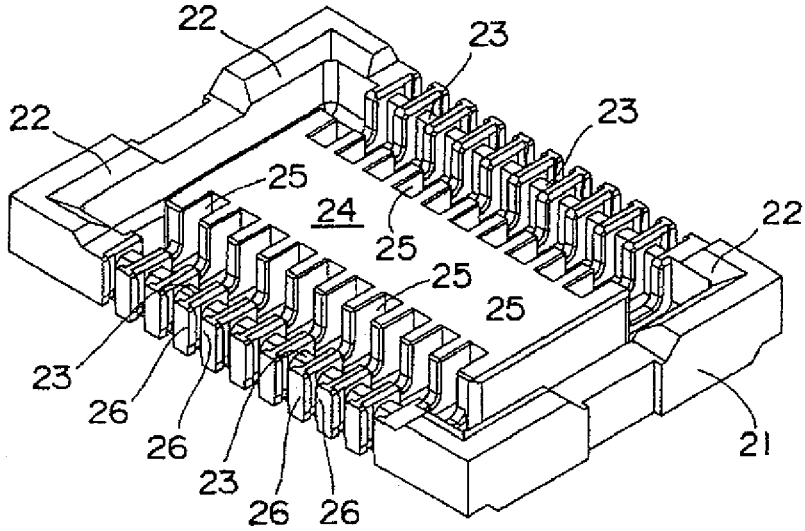
FIGS. 3A, 3B, and 3C show a perspective view, a partially enlarged plan view, and a sectional view of a socket body of the present invention.
Figure 3B:
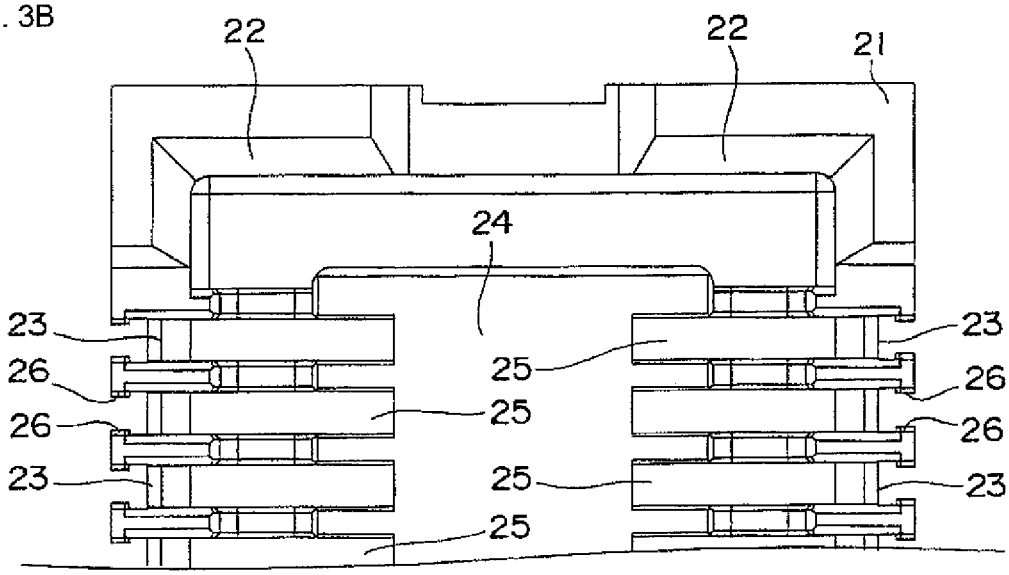
Figure 3C:
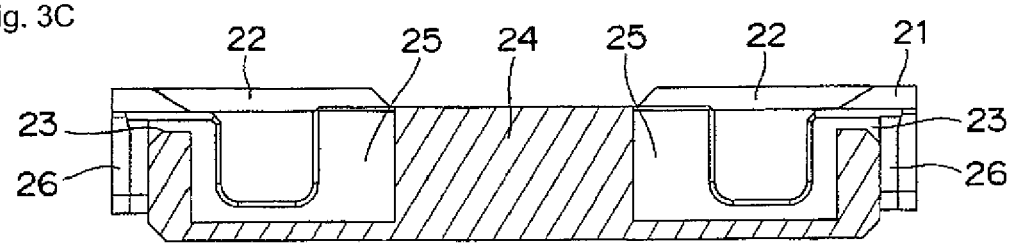
Figure 4A:
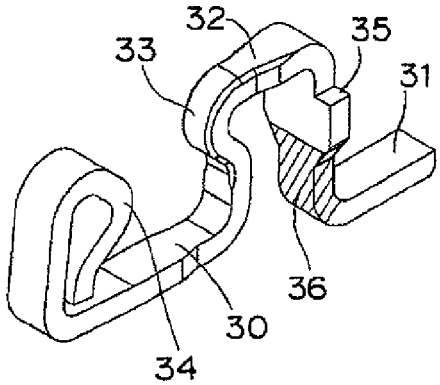
FIGS. 4A, 4B, 4C, and 4D show a perspective view of a first connector of FIG. 2, a perspective view of the first connector when viewed from a different angle, a left side view of the first connector, and a front view of the first connector.
Figure 4B:
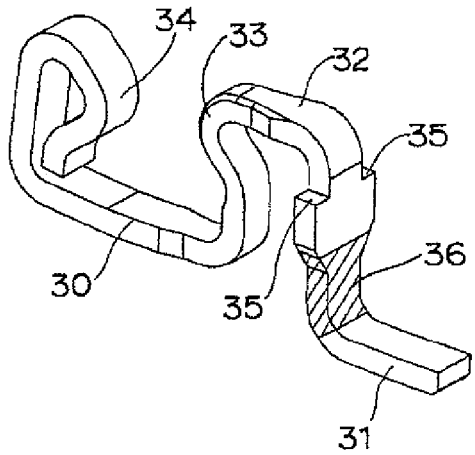
Figure 4C:
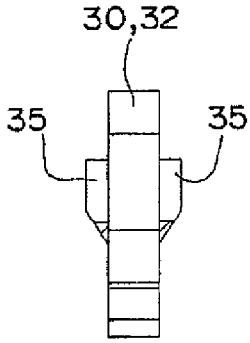
Figure 4D:
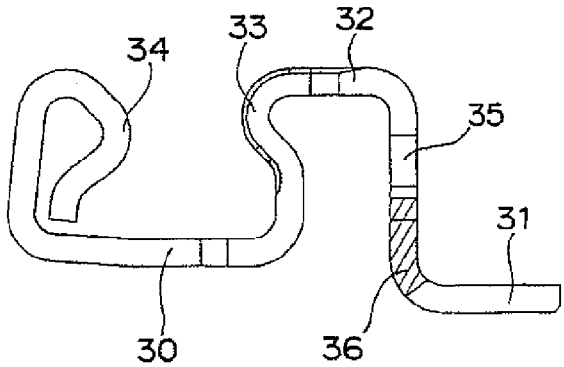
Figure 5A:
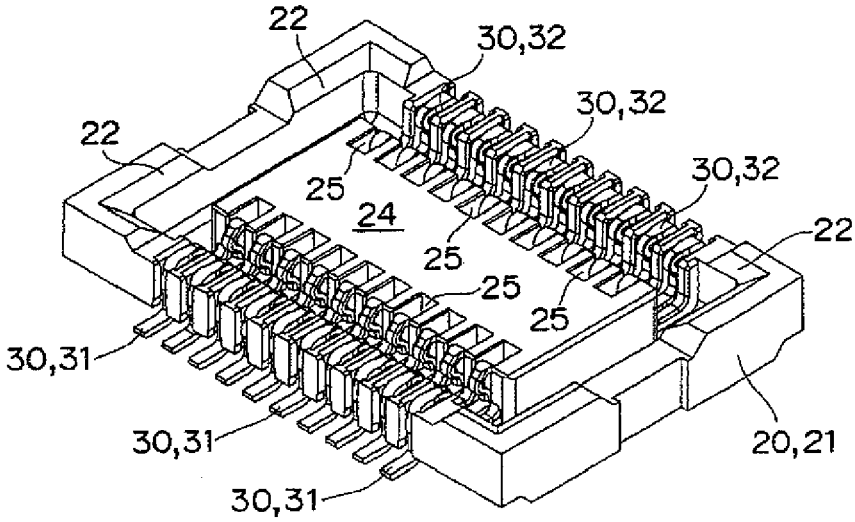
FIGS. 5A, 5B, and 5C show a perspective view, a partially enlarged plan view, and a sectional view of a socket of the present invention.
Figure 5B:
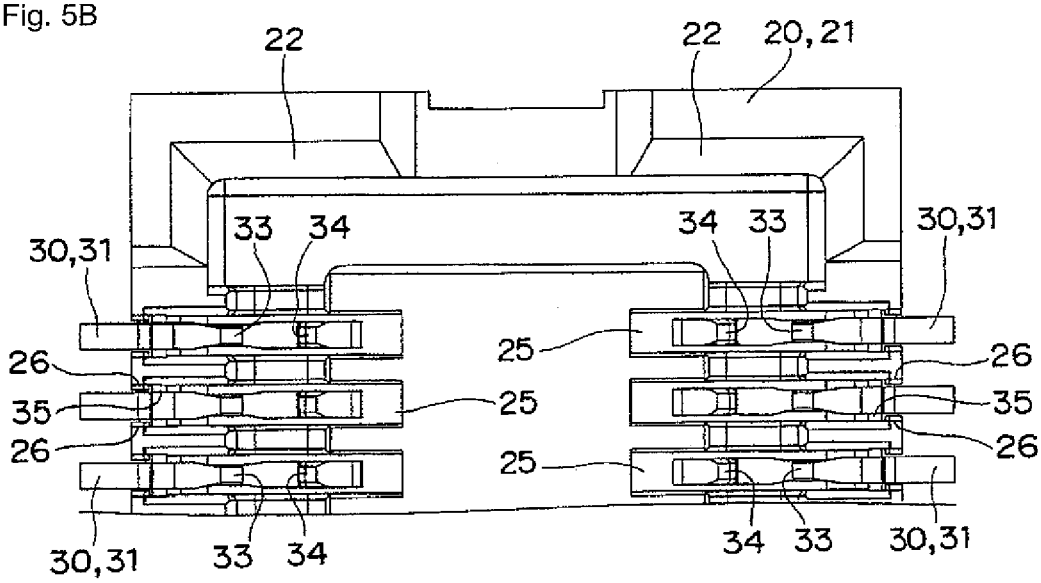
Figure 5C:
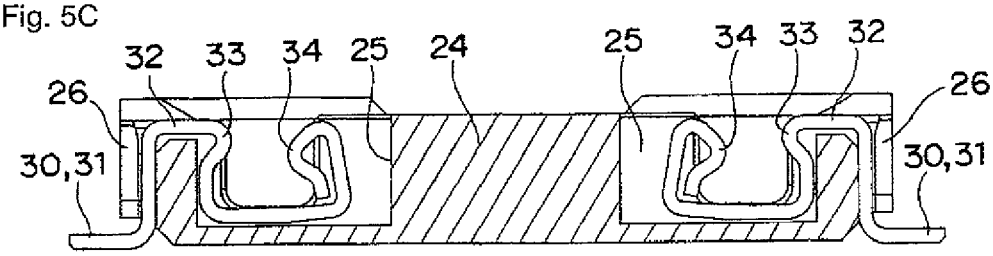

As shown in FIGS. 3, 4, and 5, in the socket 20, plural first connectors 30 are provided in parallel along opening edge portions facing each other in a socket body 21. As shown in FIG. 3, the socket body 21 is formed in a box shape having a shallow bottom, guiding tapered surfaces 22 are formed in the opening edge portions, and substantially U-shaped press-fitting grooves 23 are provided in parallel at predetermined intervals. First connectors 30, which will be described later, are press-fitted in the substantially U-shaped press-fitting grooves 23 along outer peripheral surfaces of side walls facing each other. A seat portion 24 having a planar rectangular shape is projected in the center of a bottom of the socket body 21. In the outer peripheral surface of the seat portion 24, fitting grooves 25 are provided in parallel at positions which correspond to and are communicated with the press-fitting grooves 23. The fitting groove 25 has a width larger than that of a second contact portion 34 located at a free end portion of the first connector 30. As shown in FIG. 3B, in the press-fitting groove 23, a pair of retaining ribs 26 is projected so as to face each other in inside surfaces located on the outer surface side. Obviously the guiding tapered surface 22 may be formed in a round shape.

As shown in FIG. 4, in the first connector 30, a portion extended from a connecting portion 31 is vertically bent to form a substantially U-shaped press-fitting portion 32, and an inside corner portion of the press-fitting portion 32 is projected inward to form a first contact portion 33. A free end portion extended from the press-fitting portion 32 is vertically bent and curved to form a second contact portion 34. The second contact portion 34 is projected inward so as to face the first contact portion 33. Retaining projections 35 and 35 are formed in side edge portions outside the press-fitting portion 32 respectively. Further, an Ni plating 36 (shown by hatching) is formed in a base portion outside the press-fitting portion 32 to prevent solder from rising.

Figure 11A:
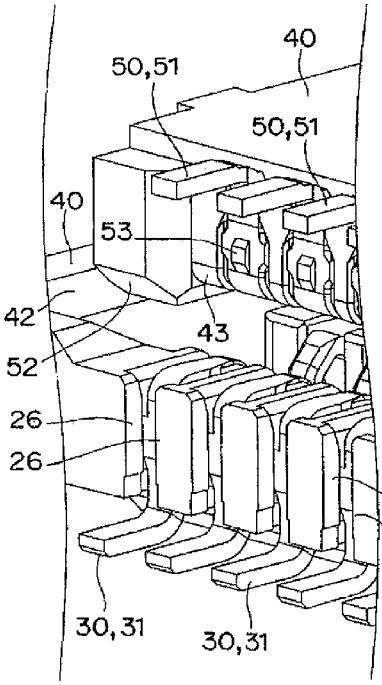
FIGS. 11A, 11B, and 11C show partially enlarged perspective views for explaining a method of assembling the plug in the socket.
Figure 11B:
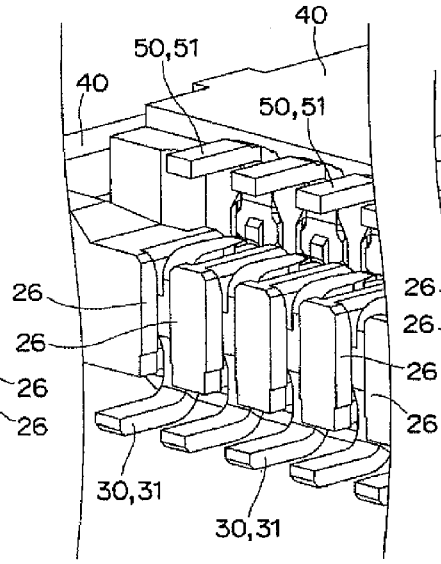
Figure 11C:
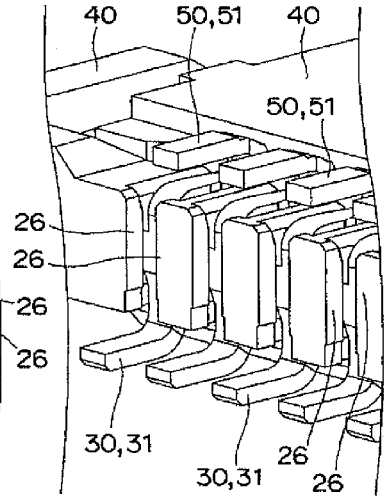

The press-fitting portion 32 of the first connector 30 is press-fitted in the press-fitting groove 23 of the socket body 21, and whereby the retaining projection 35 is latched and retained in the retaining ribs 26 and 26 of the press-fitting groove 23 (FIGS. 5B and 11). The second contact portion 34 of the first connector 30 is fitted in the fitting groove 25 of the socket body 21 with looseness. Therefore, the free end portion of the first connector 30 can elastically be deformed, and the first connector 30 can be turned in the case of a micro angle, so that the position can be adjusted by the elastic deformation of the first connector 30 even in the low component accuracy and assembly accuracy of the plug 30. Accordingly, in the embodiment, the component accuracy and assembly accuracy are not required for the socket and plug, and the socket and plug are easily produced to improve a yield.

The first connector 30 is not limited to the embodiment, but a chamfering portion formed along the outer peripheral edge portion of the press-fitting portion 32 may be eliminated as appropriate.

Figure 6A:
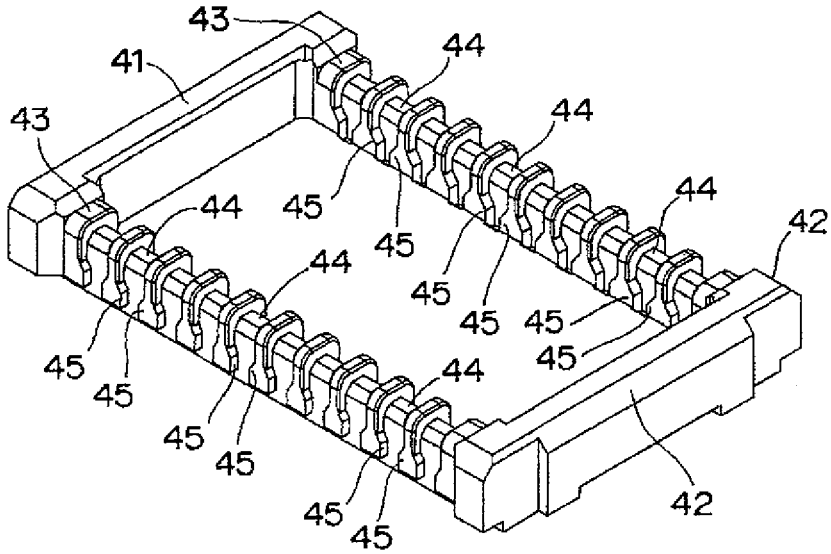
FIGS. 6A, 6B, and 6C show a perspective view, a partially enlarged plan view, and a sectional view of a plug body of the present invention.
Figure 6B:
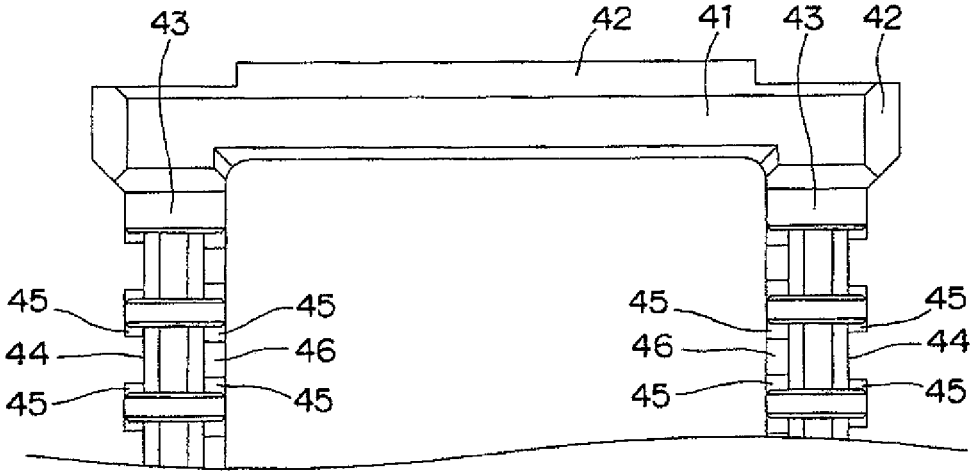
Figure 6C:
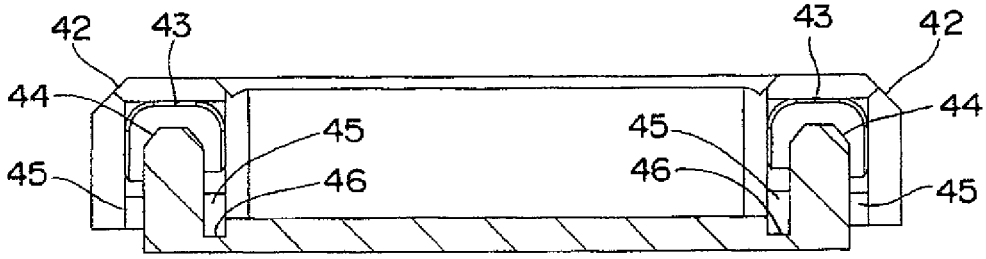
Figure 7A:
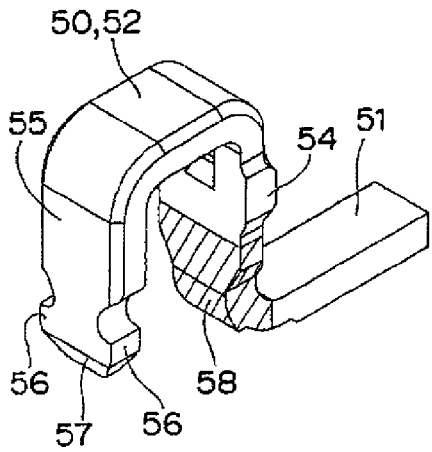
FIGS. 7A, 7B, 7C, and 7D show a perspective view of a second connector of FIG. 2, a perspective view of the second connector when viewed from a different angle, a left side view of the second connector, and a front view of the second connector.
Figure 7B:
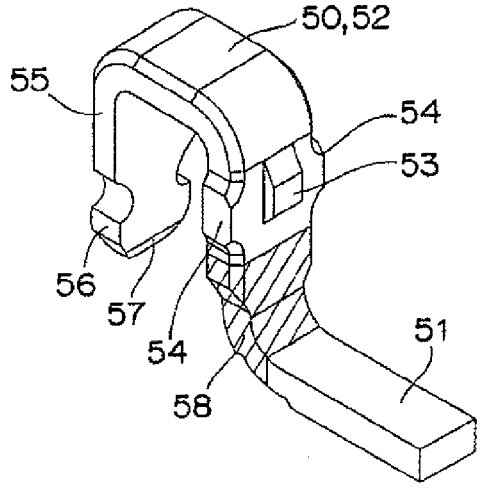
Figure 7C:
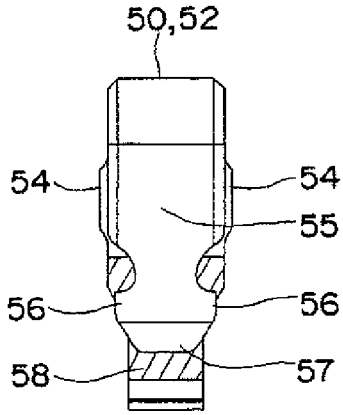
Figure 7D:
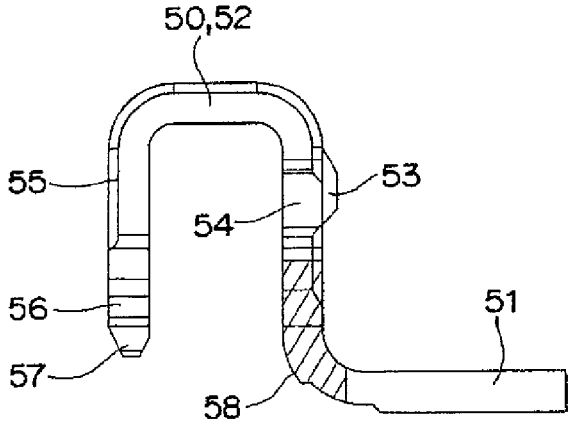
Figure 8A:
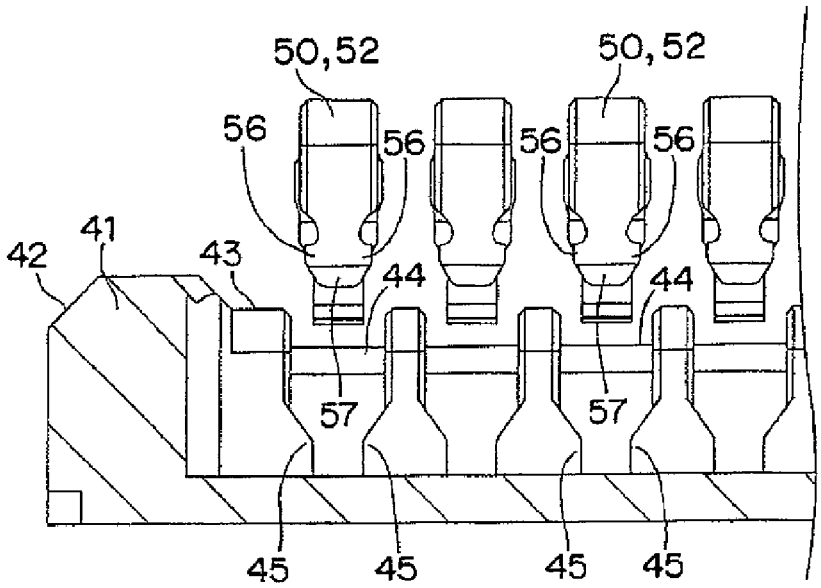
FIGS. 8A, 8B, and 8C show partially enlarged views for explaining a method of assembling the second connector in the plug body.
Figure 8B:
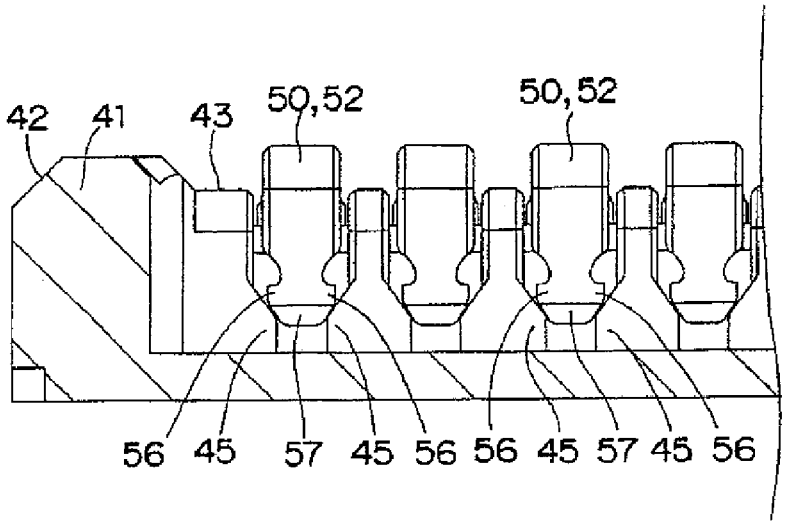
Figure 8C:
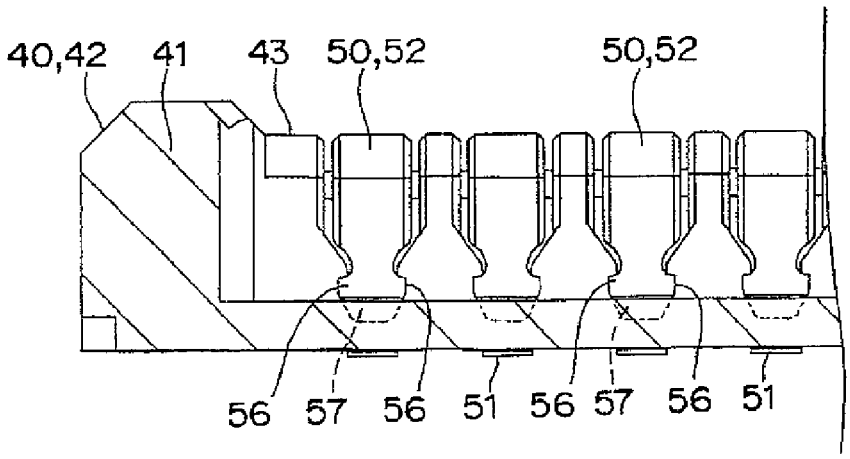

As shown in FIGS. 6, 7, and 8, in the plug 40, plural second connectors 50, which will be described later, are provided in parallel along the opening edge portions facing each other in the plug body 41. The flat plug body 41 is formed in the box shape having the shallow bottom, and the plug body 41 can be fitted in the socket body 21. Guiding tapered surfaces 42 are formed in outer peripheral edge portions of the plug body 41, and substantially U-shaped press-fitting grooves 44 are provided in parallel at predetermined intervals along the outer peripheral surfaces of side walls 43 and 43 facing each other. Second connectors 50, which will be described later, can be press-fitted in the substantially U-shaped press-fitting grooves 44 respectively. Particularly, a pair of positioning projections 45 and 45 is projected in lower edge portions inside and outside the press-fitting groove 44. Further, a position regulating recess 46 communicated with an end portion inside the press-fitting groove 44 is provided in a bottom surface of the plug body 41.

As shown in FIG. 7, the second connector 50 has a substantially U-shaped press-fitting portion 52 which is extended from a connecting portion 51 and vertically bent. A click feeling projection 53 is provided in the outside surface on the side of the connecting portion 51 of the press-fitting portion 52 by ejection forming, and lateral slippage preventing projections 54 and 54 are provided in edge portions of the outside surfaces of the press-fitting portion 52. A contact portion 55 is formed in an inward surface of the press-fitting portion 52, and latching pawls 56 and 56 are formed in side edge portions of a free end portion 57 respectively. A Ni plating 58 (shown by hatching) is formed in a base portion inside the press-fitting portion 52 to prevent the solder from rising.

The press-fitting portion 52 of the second connector 50 is press-fitted in the press-fitting groove 44 of the plug 40, and whereby the lateral slippage preventing projections 54 and 54 are regulated and positioned by the positioning projections 45 and 45 outside the press-fitting groove 44. On the other hand, as shown in FIG. 8, the latching pawls 56 and 56 of the second connector 50 are latched and retained by the positioning projections 45 and 45 respectively, and the free end portion 57 is engaged with the position regulating recess 46 to complete the assembly work. In the embodiment, advantageously the outer peripheral surface of the side wall 43 is flush with the outer peripheral surface of the second connector 50, so that the connection work can smoothly be performed.

Figure 10A:
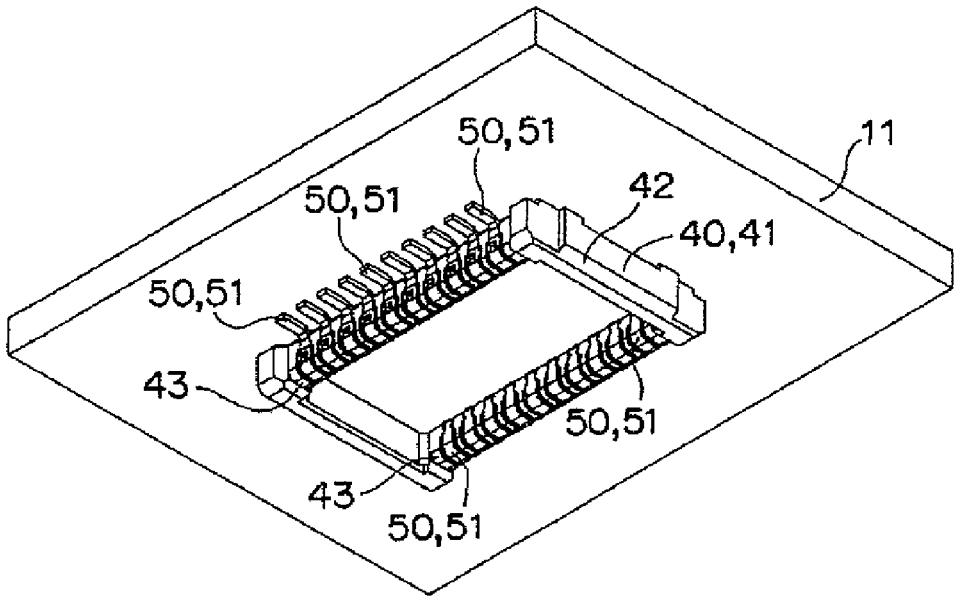
FIGS. 10A and 10B show perspective views for explaining a method of assembling the plug in the socket.
Figure 10B:
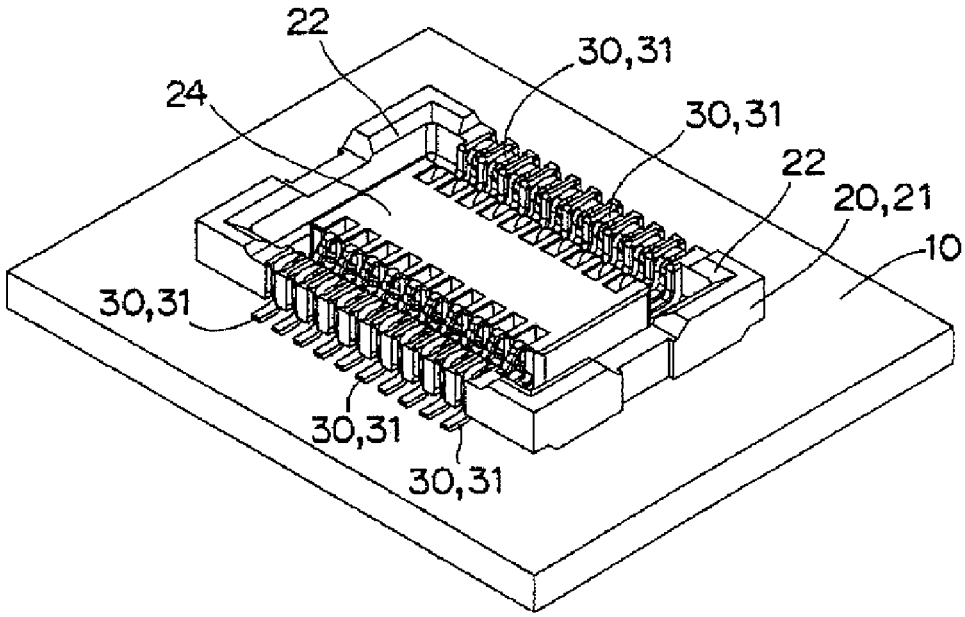
Figure 12A:
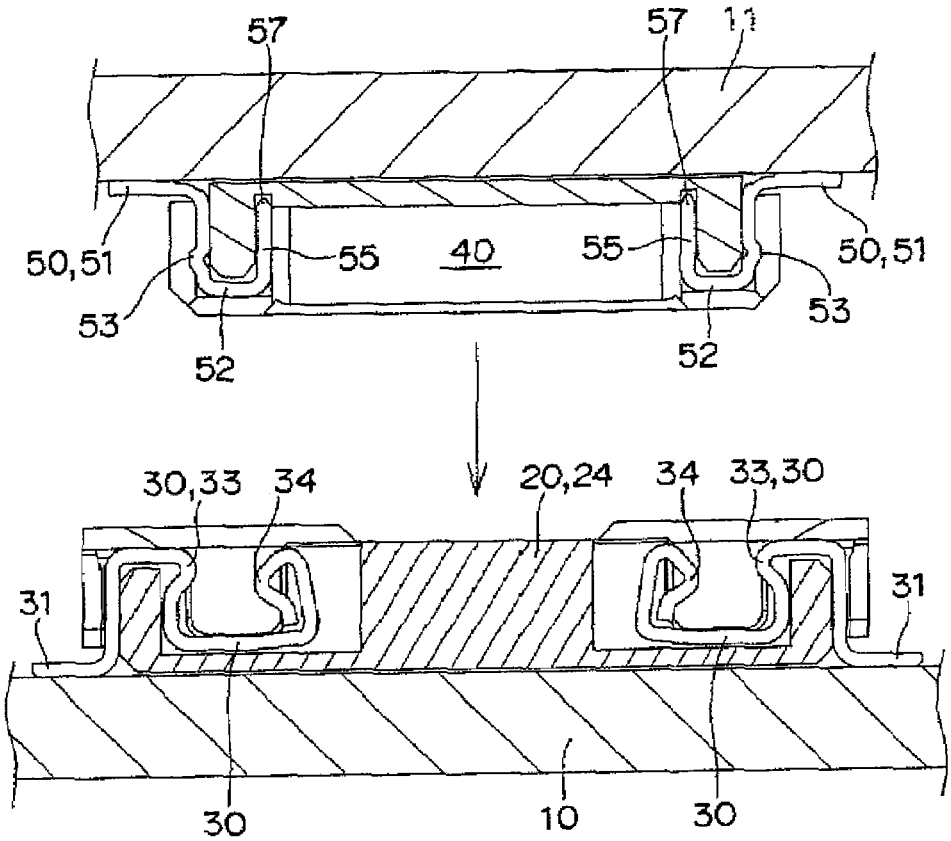
FIGS. 12A and 12B show sectional views for explaining a method of assembling the plug in the socket.
Figure 12B:
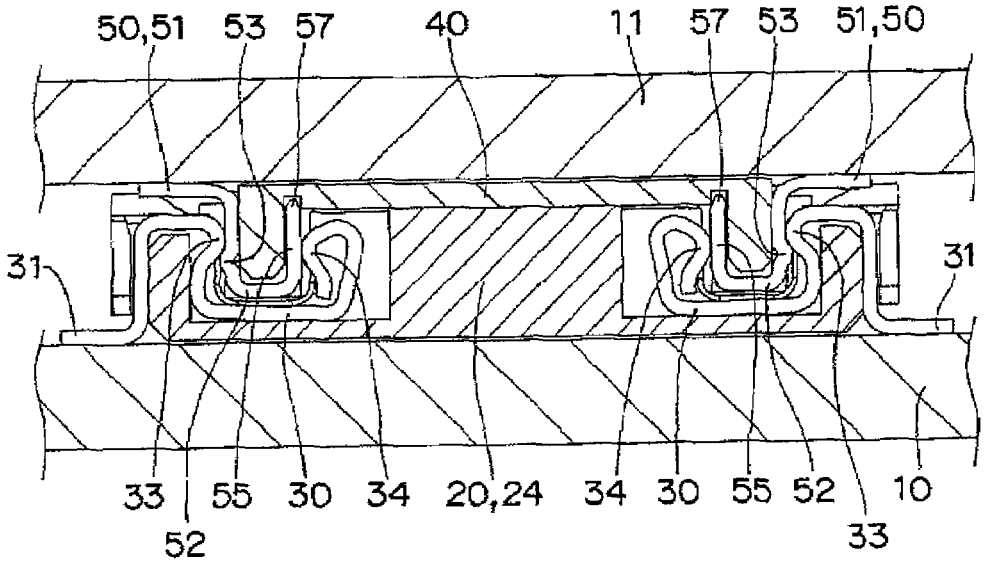

When the socket 20 and the plug 40 are connected to each other, as shown in FIGS. 10 and 12, the plug 40 attached to the lower surface of the printed wiring board 11 is disposed above the socket 20 attached to the upper surface of the printed wiring board 10. The guiding tapered surface 22 provided in the opening edge portion of the socket body 21 and the guiding tapered surface 42 provided in the outer peripheral edge portion of the plug body 41 are caused to abut on each other to roughly perform the positioning. When the plug 40 is lowered, the press-fitting portion 52 of the second connector 50 is lowered while widening the second contact portion 34 of the first connector 30. The click feeling projection 53 of the second connector 50 crosses over the first contact portion 33 by further pressing the plug 40. The first contact portion 33 and second contact portion 34 of the first connector 30 are elastically brought into contact with the click feeling projection 53 and contact portion 55 of the second connector 50 to establish the electrical conduction respectively.

Figure 9A:
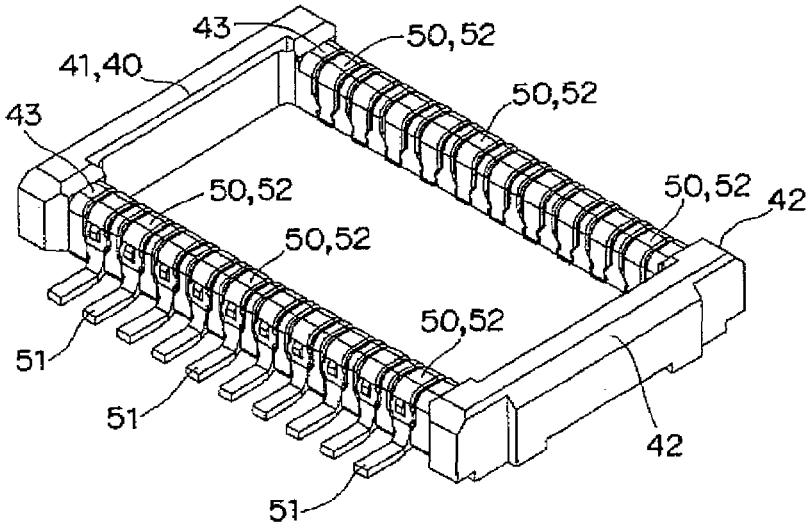
FIGS. 9A, 9B, and 9C show a perspective view, a partially enlarged plan view, and a sectional view of the plug of the present invention.
Figure 9B:
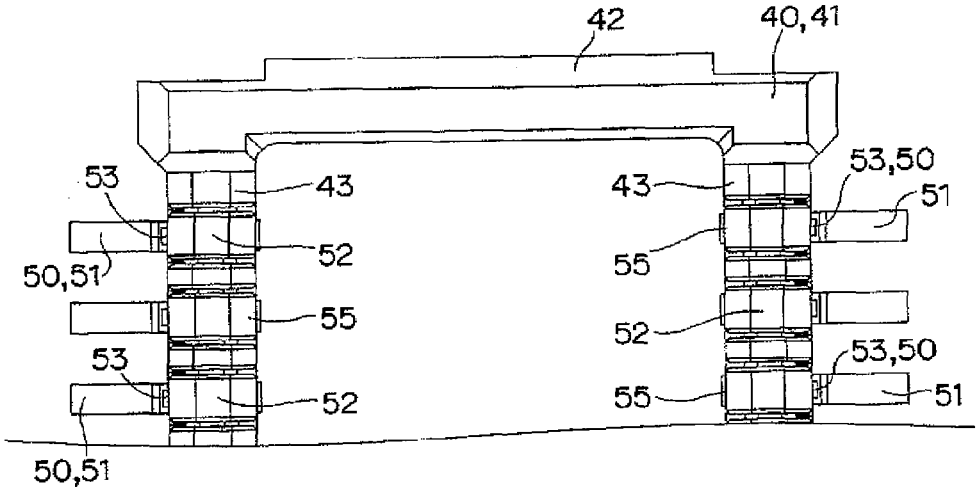
Figure 9C:
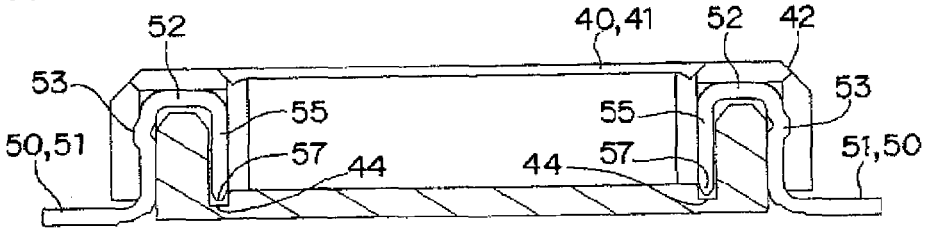

In the embodiment, as shown in FIG. 9C, the free end portion 57 does not spring because the free end portion 57 of the second connector 50 is engaged with the position regulating recess 44 of the plug body 41. Therefore, the fluctuation is not generated in the width of the press-fitting portion 52 of the second connector 50, i.e., a distance between the click feeling projection 53 and the contact portion 55, and the contact pressure becomes even between the first connector 30 and the second connector 50. Moreover, because the free end portion 57 is not laterally swung, there is no risk of contacting the free end portions 57 with each other, and contact reliability is advantageously enhanced.

In the embodiment, because the press-fitting portion 52 including the click feeling projection 53 is press-fitted between the first and second contact portions 33 and 34, the press-fitting portion 52 can be retained, and the click feeling in which the connection state can be confirmed by a feeling is obtained to give a secure feeling to a worker.

Figure 1A:
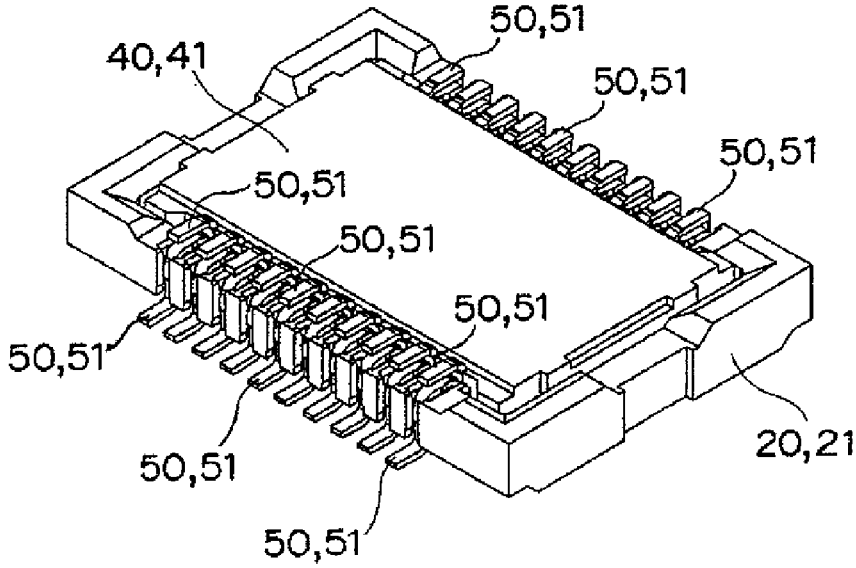
FIGS. 1A and 1B show a perspective view of a socket and a plug for explaining a method of connecting an electrical connector according to the present invention.
Figure 1B:
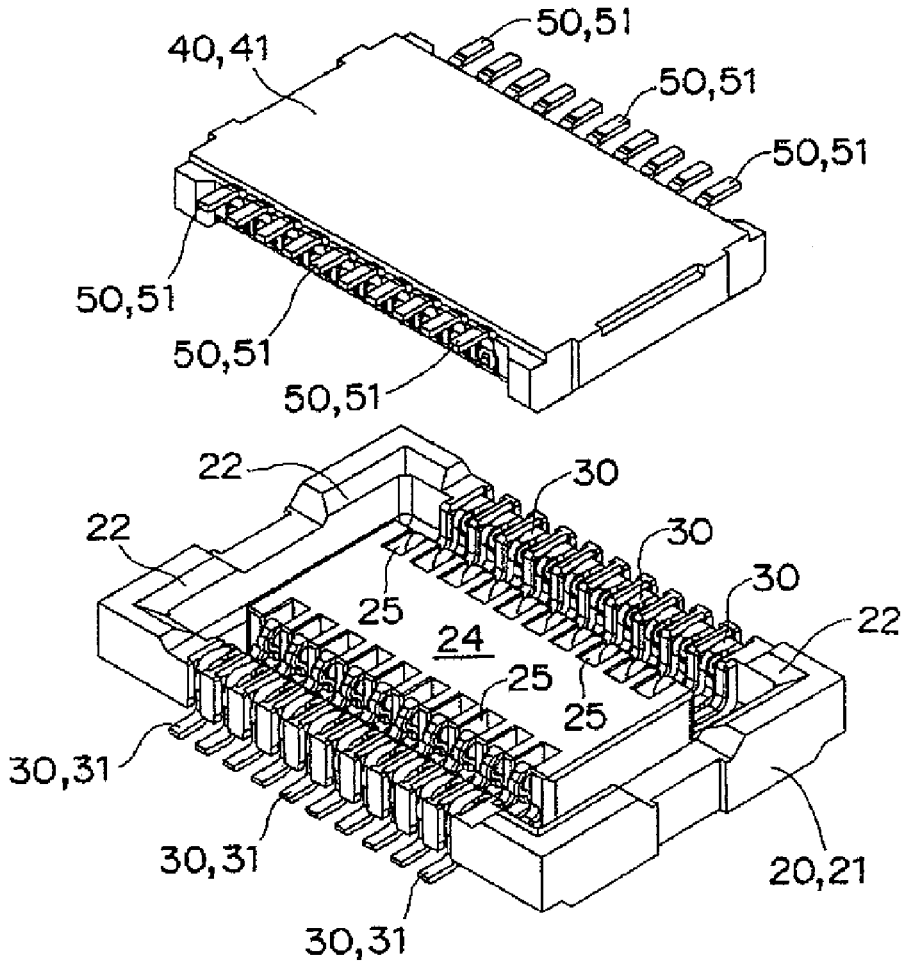
Figure 2:
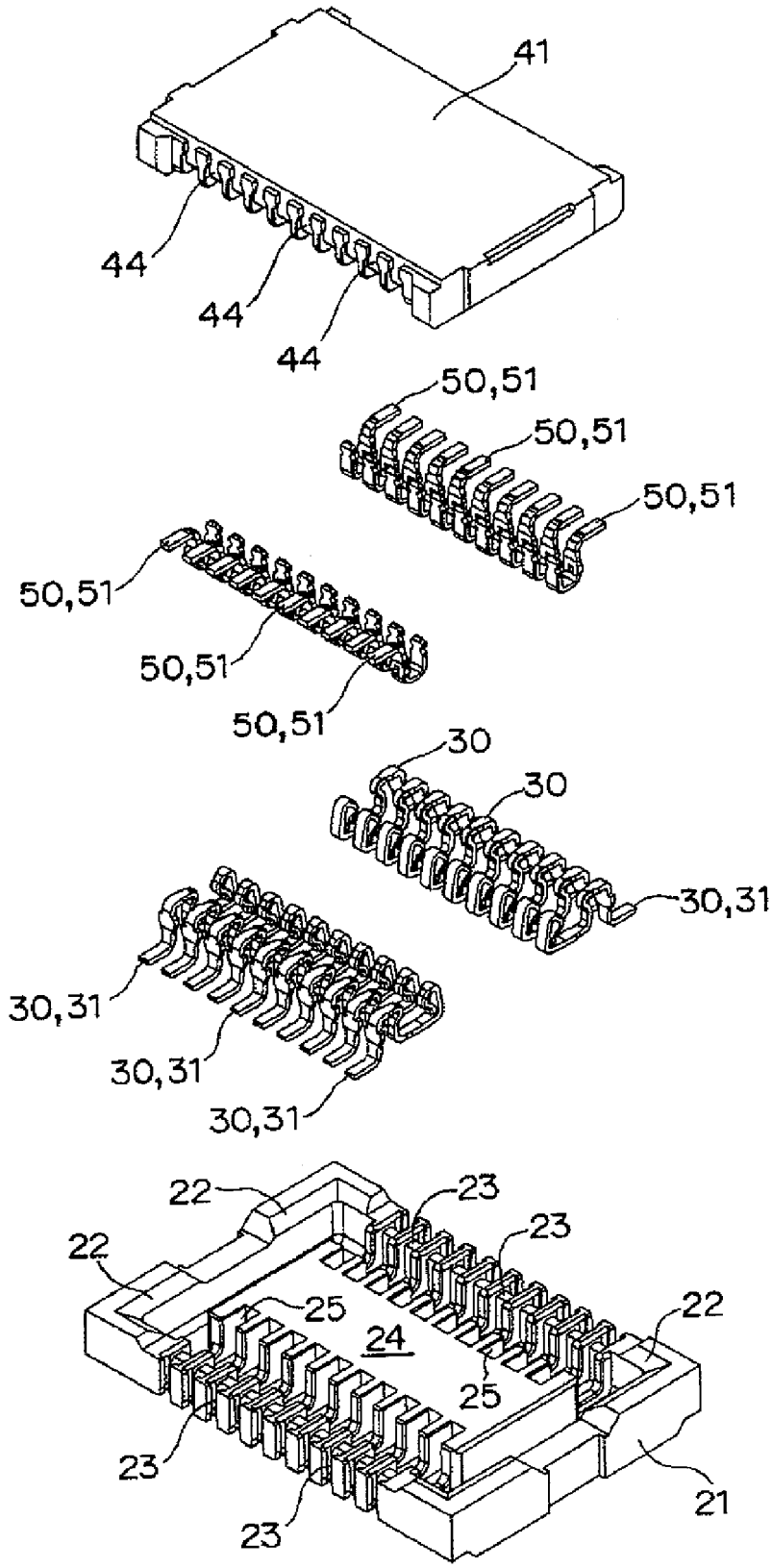
FIG. 2 shows an exploded perspective view of the electrical connector of the present invention of FIG. 1.

Additionally, as shown in FIG. 2, the second contact portion 34 of the first connector 30 biases the press-fitting portion 52 of the second connector 50 toward the outside. Therefore, the press-fitting portion 52 contacts elastically the first contact portion 33 with a stronger force while being engaged with the first contact portion 33, so that the contact reliability can be enhanced.

The electrical connector of the present invention can be applied to not only the connection of the printed wiring boards but also the connection of other electrical devices.

What is claimed is:

1. An electrical connector comprising:

a socket in which a plurality of first connectors are provided in parallel, substantially U-shaped press-fitting portions being assembled so as to cross over opening edge portions of a socket body; and a plug in which a plurality of second connectors are provided in parallel, substantially U-shaped press-fitting portions being assembled at positions corresponding to the first connectors so as to cross over opening edge portions of a plug body, the plug body having a planar shape which can be fitted in the opening edge portions of the socket body, wherein a free end portion of the press-fitting portion of the second connector located in the opening edge portion of the plug body is engaged with a position regulating recess formed in a bottom surface of the plug body.

2. The electrical connector according to claim 1, wherein lateral slippage is prevented by press-fitting the substantially U-shaped press-fitting portions of the second connector in the plurality of substantially U-shaped press-fitting grooves provided in parallel along an outer peripheral surface of the opening edge portion of the plug body.

3. The electrical connector according to claim 2, wherein lateral slippage preventing projections press-contacting inside surfaces of the press-fitting groove of the plug body are provided in end faces on both sides of the press-fitting portion of the second connector, and a click feeling projection is provided in a side face of the press-fitting portion located between the lateral slippage preventing projections.

4. The electrical connector according to claim 2, wherein lateral slippage preventing projections press-contacting inside surfaces of the press-fitting groove of the plug body are provided in end faces on both sides located outside the opening edge portion of the plug body in the press-fitting portion of the second connector, and a click feeling projection is provided in an outward surface of the press-fitting portion located between the lateral slippage preventing projections.

5. The electrical connector according to claim 2, wherein an outer peripheral surface of the opening edge portion of the plug body is substantially flush with an outer peripheral surface of the press-fitting portion of the second connector.

6. The electrical connector according to claim 1, wherein Ni plating is made in a boundary region between the connecting portion and press-fitting portion of the connector.

7. The electrical connector according to claim 3, wherein lateral slippage preventing projections press-contacting inside surfaces of the press-fitting groove of the plug body are provided in end faces on both sides located outside the opening edge portion of the plug body in the press-fitting portion of the second connector, and a click feeling projection is provided in an outward surface of the press-fitting portion located between the lateral slippage preventing projections.

8. The electrical connector according to claim 3, wherein an outer peripheral surface of the opening edge portion of the plug body is substantially flush with an outer peripheral surface of the press-fitting portion of the second connector.

9. The electrical connector according to claim 2, wherein Ni plating is made in a boundary region between the connecting portion and press-fitting portion of the connector.

10. The electrical connector according to claim 3, wherein Ni plating is made in a boundary region between the connecting portion and press-fitting portion of the connector.

* * * * *